US005906240A

United States Patent [19]

Kilgore et al.

[11] Patent Number: 5,906,240

[45] Date of Patent: May 25, 1999

[54] SLIP HAVING PASSAGEWAY FOR LINES THERETHROUGH

[75] Inventors: Marion D. Kilgore, Dallas; Dennis D. Rood, Carrollton, both of Tex.

[73] Assignee: Halliburton Energy Services, Inc., Dallas, Tex.

[21] Appl. No.: 08/915,295

[22] Filed: Aug. 20, 1997

[51] Int. Cl.[6] ..... E21B 23/01

[52] U.S. Cl. ..... 166/217; 166/206

[58] Field of Search ..... 166/118, 134, 166/138, 206, 217, 241.5, 241.6, 382

[56] References Cited

U.S. PATENT DOCUMENTS

| | | | |
|---|---|---|---|
| 1,745,572 | 2/1930 | Gray et al. | 166/118 X |
| 1,907,825 | 5/1933 | Johnson | 166/241.6 |
| 3,419,079 | 12/1968 | Current | 166/206 |
| 3,530,934 | 9/1970 | Kisling, III | 166/134 |
| 4,441,553 | 4/1984 | Setterberg, Jr. et al. | 166/138 |
| 4,582,134 | 4/1986 | Gano et al. | 166/120 |
| 5,086,845 | 2/1992 | Baugh | 166/382 |
| 5,701,954 | 12/1997 | Kilgore et al. | 166/119 |

OTHER PUBLICATIONS

Otis Catalog AppeNdix entitleD "Type Go Otis Slim–Hole Packers", p. 67 (undated).

Otis Production Packers and Accessories Technical Brochure entitled "Otis Utility Production Packers", p. 32 (undated).

Otis Production Packers and Accessories Technical Brochure entitled "Otis Hanger Systems", p. 54 (undated).

Otis Production Packers and Accessories Technical Brochure entitled "Otis Liner Hangers", p. 64 (undated).

*Primary Examiner*—George Suchfield

*Attorney, Agent, or Firm*—Paul I. Herman; Marlin R. Smith

[57] ABSTRACT

A slip having a passageway for installation of lines therethrough and associated anchoring device provides uniform gripping engagement with a wellbore without unduly stressing the slip or casing, and without requiring complex manufacturing and assembly. In a described embodiment, a slip has slip segment, transitional and C-ring axial portions. The slip segment portion includes multiple axially elongated and circumferentially spaced apart slip segments. Each slip segment is attached to an axial end of the C-ring portion by a transitional element. When the slip is extended into engagement with a wellbore, the transitional portion permits the slip segments to flex and uniformly apply a gripping force to the wellbore.

39 Claims, 6 Drawing Sheets

SLIP HAVING PASSAGEWAY FOR LINES THERETHROUGH

BACKGROUND OF THE INVENTION

The present invention relates generally to anchoring devices utilized in subterranean wells and, in an embodiment described herein, more particularly provides a slip having a passageway for lines therethrough and an anchoring device including such slip.

Anchoring devices are generally utilized in subterranean wells to permanently or temporarily fix the location of an assembly relative to a wellbore of the well, and may be fitted with seal elements, such as packer rubbers, to provide a fluid tight seal against the wellbore or other tubular configuration, such as casing, segmented tubing, coiled tubing, liner, or other downhole tool having an inner tubular configuration, when the anchoring device is set. As used herein, the term "wellbore" is used to designate the axially extending bore formed through an earthen formation intersected by a well, as well as other tubular configurations in which an anchoring device may be set, including casing, segmented tubing, coiled tubing, liner, a downhole tool having an axially extending inner bore, etc.

Typical anchoring devices include plugs, packers, liner hangers, tubing hangers, locks, and others. In order to grip the wellbore, which may or may not be lined with protective casing, a typical anchoring device is fitted with one or more elements commonly referred to as slips, which extend radially outward from the anchoring device to bite into, or otherwise grippingly engage, the wellbore when the anchoring device is set. If the anchoring device is temporarily installed, or is intended to be later retrieved from the well, it may also be fitted with a mechanism which retracts the slips out of engagement with the wellbore when desired.

A common type of slip is an individual slip segment. Three or four of these types of slips are usually distributed circumferentially about the exterior of an anchoring device. The slips are typically axially elongated with serrated edges formed on their outside surfaces. Each slip is generally extended and retracted independently of the other slips on the anchoring device, although the same extension and retraction mechanisms may extend and retract all of the slips simultaneously.

When, however, individual slip segments are utilized in an anchoring device which must resist very large loads and/or fluid pressure, several problems with their use become evident. For example, it is difficult to ensure that all of the slip segments extend and grip the wellbore uniformly, so that the anchoring device is centered in the wellbore and is ideally positioned for resisting the loads placed on it. As another example, in order for the slips to adequately grip a wellbore lined with casing, each slip typically must be forced under great contact pressure at a discreet point against the inner surface of the casing, which frequently deforms the casing at that point and prevents subsequent sealing thereto.

Another type of slip used on anchoring devices is known as a barrel slip. This type of slip is typically formed from a tubular piece of material having a serrated or other gripping surface on its outer side surface. In order to make the barrel slip radially deflectable, multiple longitudinal slots are cut partially axially through the tubular material from each of its opposite ends, the slots from each end alternating circumferentially about the tubular material and laterally overlapping each other. In this way, barrel slips permit relatively uniform distribution of gripping force to the wellbore, prevent or reduce damage to casing, and aid in centering the anchoring device within the wellbore.

Unfortunately, typical barrel slips, being circumferentially continuous, do not permit the passage of lines, such as hydraulic, electrical, fiber optic and other control lines, instrument lines, etc., thereacross when an anchoring device is set within a wellbore. Such lines may be passed through a type of slip known as a C-ring slip, however. The C-ring slip is a generally tubular slip with one longitudinal slot extended completely axially through the slip, so that the slip is circumferentially parted and has a generally C-shaped cross-section. It is then possible to route external lines axially through the longitudinal slot.

However, by circumferentially parting a tubular slip to produce a C-ring slip, certain of the disadvantages of individually segmented slips are reintroduced, and certain other disadvantages are added. For example, a C-ring slip does not radially extend or retract uniformly. It is circular in cross-section only when at rest, and will tend to form an elliptical, oval, oblong or other nonuniform shape when radially extended. This results in nonuniform gripping of the wellbore, thereby reducing the load rating of the anchoring device and producing high localized stresses in the wellbore.

As another example, a C-ring slip is typically stressed greatest at a longitudinally extending area radially opposite its longitudinal split, that is, one hundred eighty degrees from the axial slot extending completely through the slip. This greatest stress often occurs at assembly of the anchoring device when the slip is expanded and installed over one or more wedges used to extend the slip, and the slip material yield stress is frequently exceeded, resulting in the slip taking a "set". Such stressing of the slip material will sometimes lead to stress corrosion cracking in service, and enhanced corrosion in the presence of common wellbore fluids, such as hydrogen sulfide.

In order to alleviate these effects of assembling a C-ring slip over the wedges on the anchoring device, some anchoring devices have been produced with helically formed wedges. The slip is likewise manufactured with a complementarily shaped helical inner profile, and the slip is, in essence, threaded onto the anchoring device. However, this increases manufacturing costs and increases assembly complexity, without resolving the problems of overstress of the slip and nonuniform extension and retraction of the slip.

From the foregoing, it can be seen that it would be quite desirable to provide a slip which is capable of uniformly applying a gripping force to casing lining a wellbore, minimizes damage to the casing, permits the passage of lines therethrough, and which may be assembled onto an anchoring device without undue stress and without requiring complex assembly and manufacturing techniques. It is accordingly an object of the present invention to provide such a slip and associated anchoring device.

SUMMARY OF THE INVENTION

In carrying out the principles of the present invention, in accordance with an embodiment thereof, a slip is provided which is a series of circumferentially distributed slip segments joined to a C-ring via a corresponding series of transition elements. An anchoring device is also provided which utilizes the slip and includes one or more external lines extending axially through the slip.

In broad terms, a slip is provided which includes first, second and third axial portions. The first axial portion is configured for engaging a wellbore or an apparatus positioned within a wellbore by radial deflection. The second axial portion is a generally tubular element with a generally C-shaped cross-section. The third axial portion attaches the first axial portion to the third axial portion in a manner permitting the first axial portion to flex relative to the third axial portion.

In one aspect of the present invention, the first axial portion includes a series of circumferentially distributed and axially elongated engagement members or slip segments. The slip segments are separated by a series of axially extending slots formed from one end of the slip to the third axial portion. The slips may have serrated external surfaces for gripping engagement with the wellbore.

In another aspect of the present invention, the second axial portion has a slot extending axially through a sidewall portion thereof. This slot provides a passageway for lines to extend axially through the slip.

In yet another aspect of the present invention, the third axial portion includes a series of transition elements. Each of the transition elements attaches one of the slip segments to an end of the C-ring. The slip segments may, thus, deflect radially outward into uniform contact with the wellbore (or other device), even though the C-ring may not uniformly deflect.

An anchoring device is also provided by the present invention. The anchoring device has a set of lines extending axially through a slip disposed thereon.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
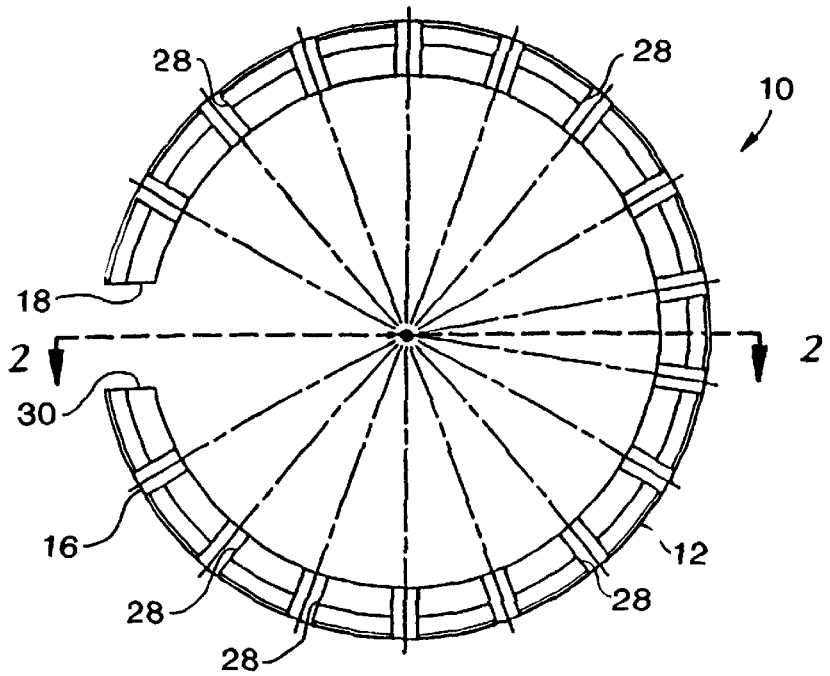
FIG. 1 is an end view of a slip embodying principles of the present invention.
Figure 2:
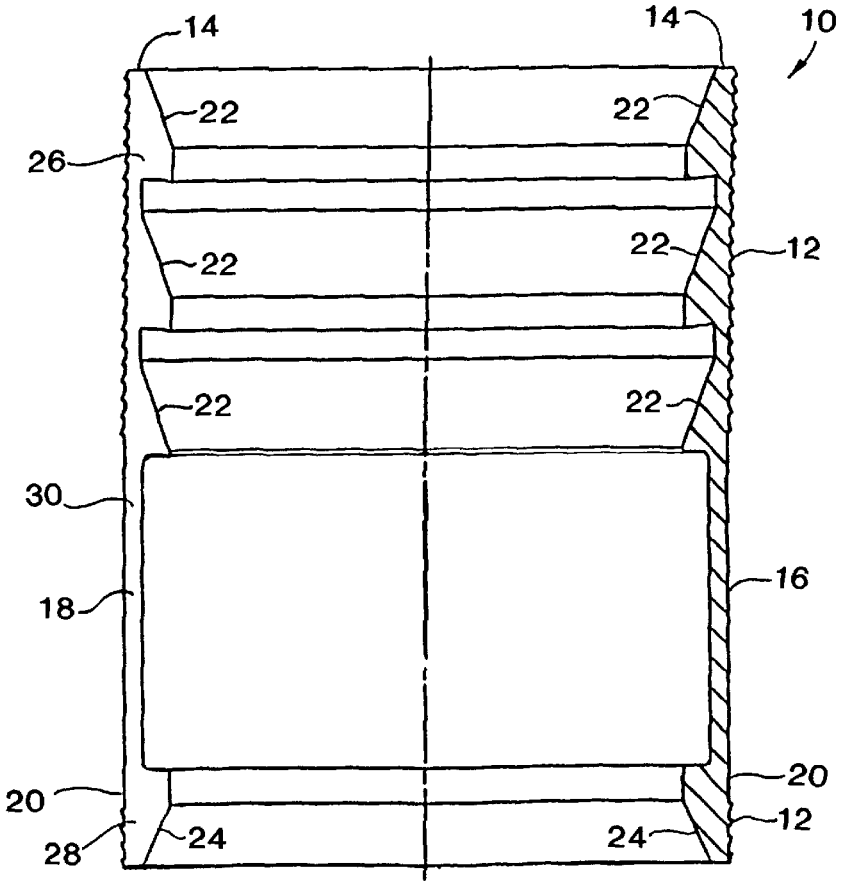
FIG. 2 is a cross-sectional view through the slip, taken along line 2—2 of FIG. 1.
Figure 3:
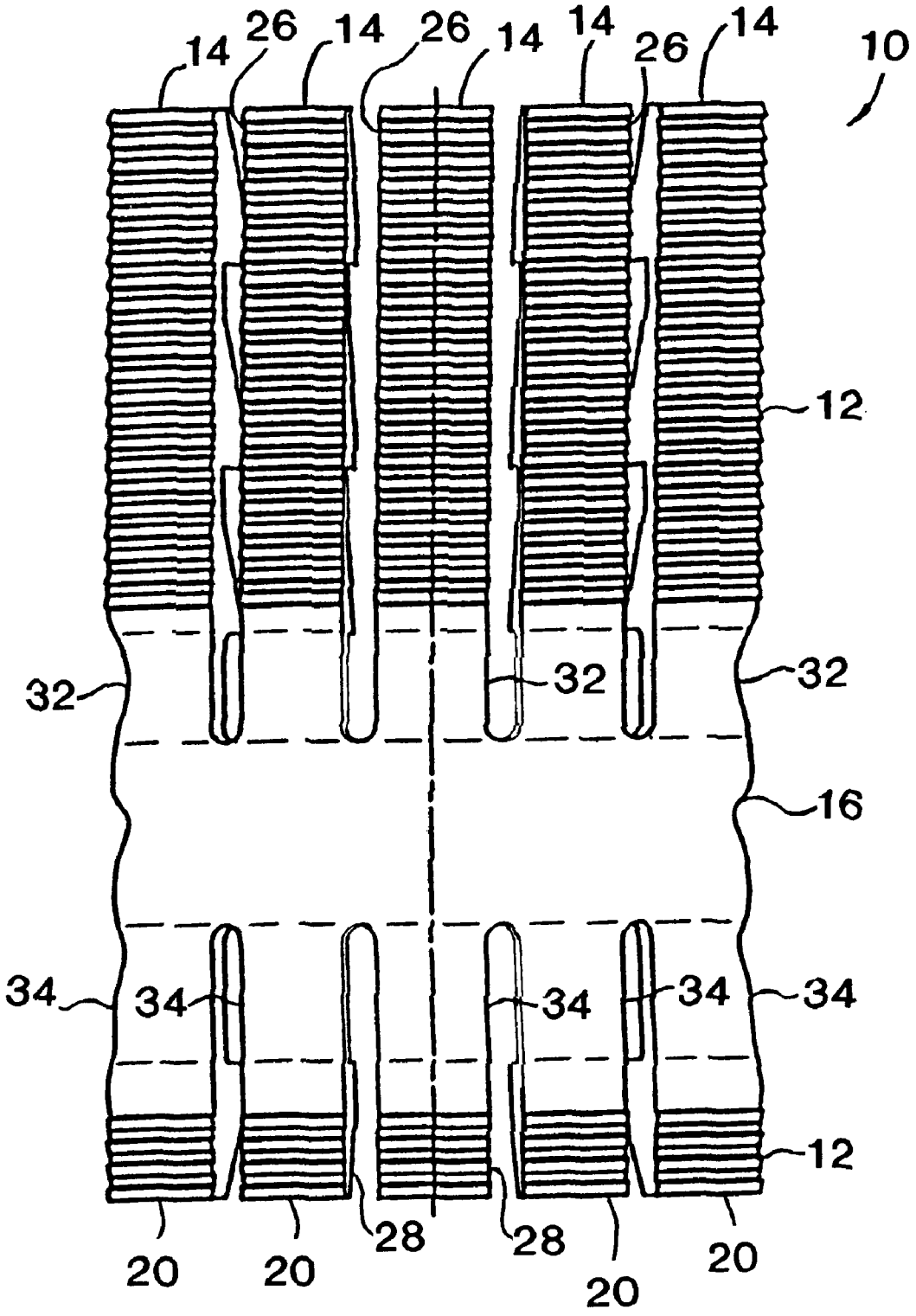
FIG. 3 is a partial elevational view of the slip of FIG. 1.

Representatively illustrated in FIGS. 1–3 is an engagement device 10 which embodies principles of the present invention. In the following description of the engagement device 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The engagement device 10 is depicted as a slip having teeth 12 formed on an outer side surface thereof. The teeth 12 are in the form of a series of circumferential serrations extending axially along an upper and a lower portion of the slip 10 for gripping engagement with a wellbore lined with protective casing. However, it is to be understood that the engagement device 10 may be otherwise configured for engagement with other items of equipment within a wellbore, such as landing nipples, liners, tubing, internal profiles of downhole tools, etc., without departing from the principles of the present invention. For example, the engagement device 10 may be configured to engage an internal profile, such as in a landing nipple, a profile in a safety valve housing, etc., in which case the engagement device would preferably not have teeth 12 formed on its outer side surface, but would be at least partially complementarily shaped relative to the internal profile. Thus, an engagement device constructed in accordance with the principles of the present invention may be utilized in a variety of applications for engagement with a variety of items of equipment.

In the embodiment of the engagement device 10 depicted and described herein, the engagement device is configured for uniform gripping engagement with a wellbore, while minimizing stresses imparted to the device and wellbore, and permitting lines to be installed therethrough. Uniform gripping engagement is provided by an upper series of elongated axially extending segments 14 attached to one axial end of a generally tubular body 16. The body 16 has a slot 18 formed completely axially through a sidewall portion thereof, and so the body has a generally C-shaped cross-section. Further uniform gripping engagement is provided by a lower series of elongated axially extending segments 20 attached to the other axial end of the body 16. For illustrative clarity, FIG. 2 shows the engagement device 10 as if the segments 14, 20 are not divided circumferentially.

Note that the teeth 12 are oppositely inclined on the upper segments 14 as compared to those formed on the lower segments 20. In the engagement device 10, the upper segments 14 are configured to resist a greater axial load than the lower segments 20, and to resist that greater load in an opposite direction. Thus, the engagement device 10 is particularly suited to resist a greater load in one axial direction, and to resist a lesser load in the opposite axial direction. It is to be clearly understood, however, that it is not necessary in keeping with the principles of the present invention for the engagement device 10 to have more than one series of segments, for one series of segments to be configured to resist a greater or lesser load than another series of segments, or for the segments to be configured to resist a load from a particular direction.

Figure 4A:
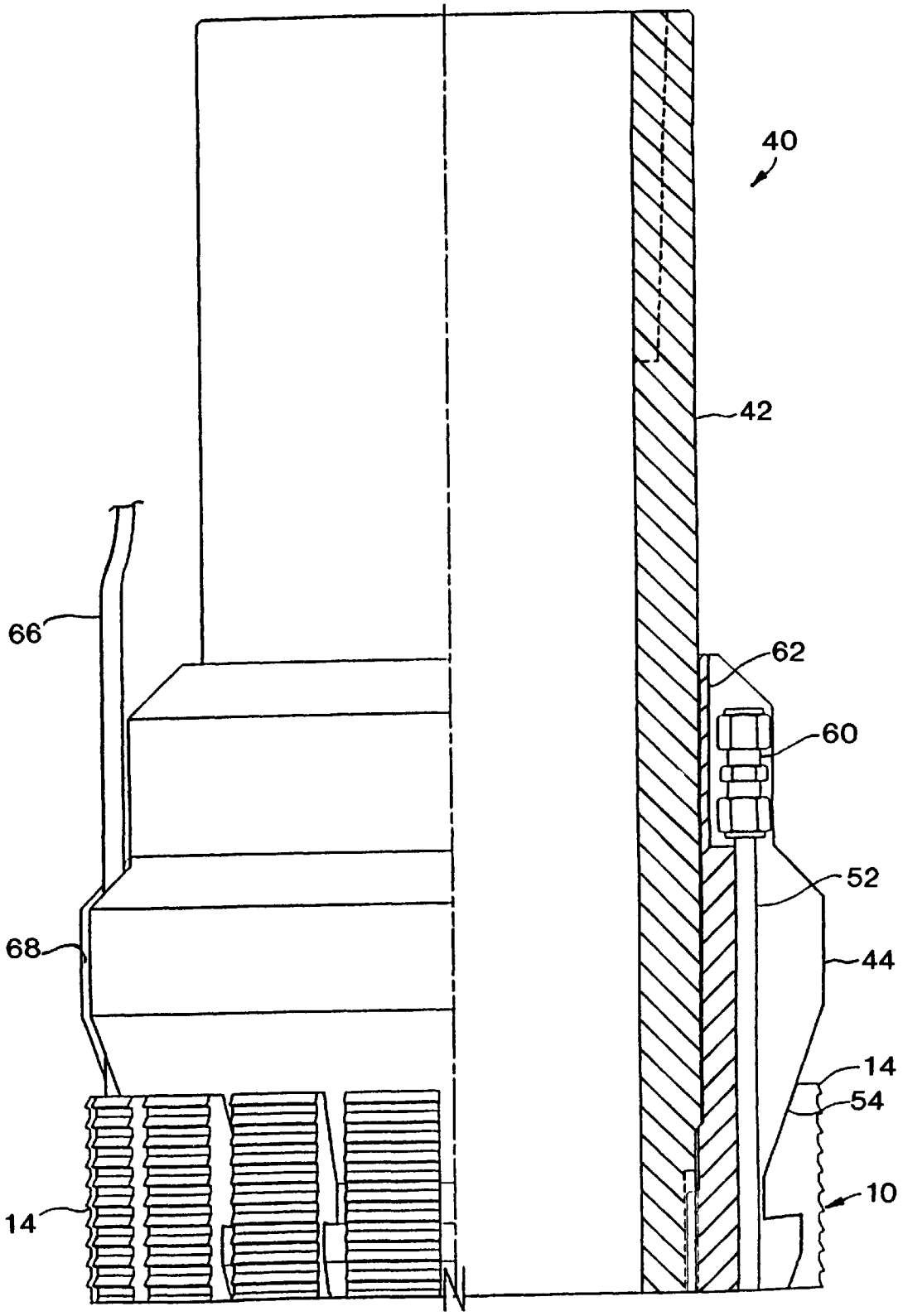
FIGS. 4A–4C are quarter-sectional views of successive axial sections of an anchoring device embodying principles of the present invention.
Figure 4B:
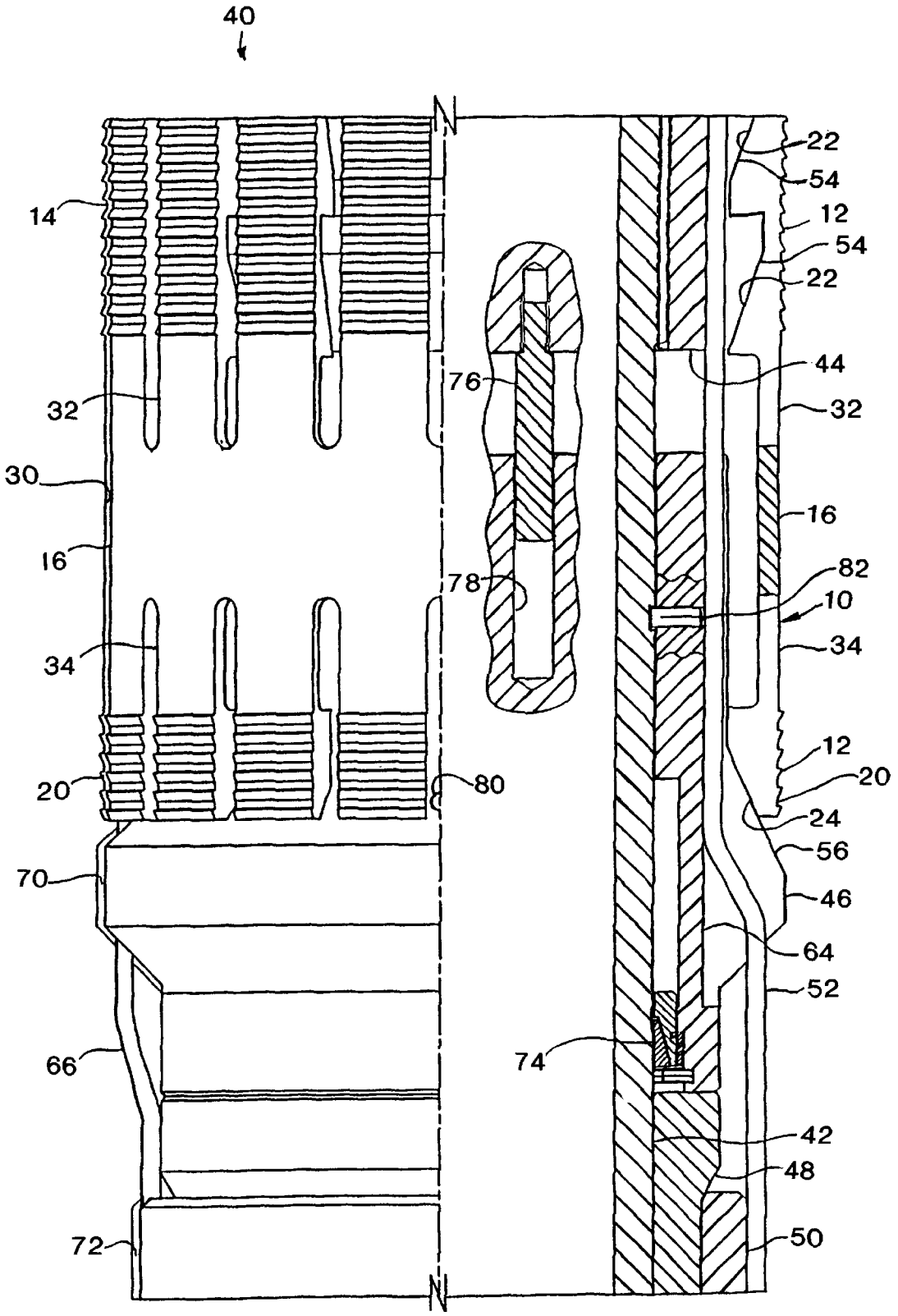
Figure 4C:
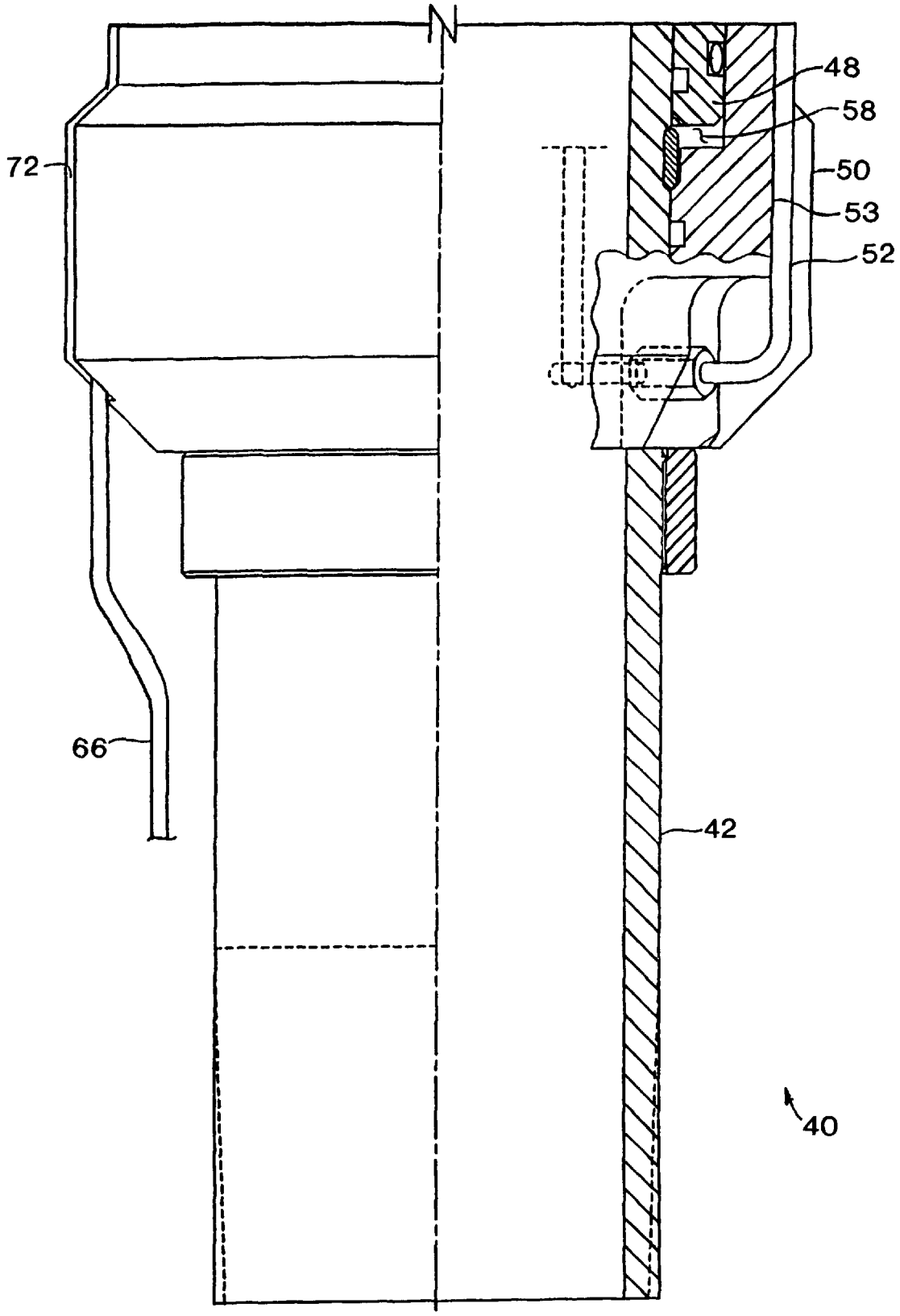

The slip 10 is configured for installation on a cooperatively designed anchoring device (not shown in FIGS. 1–3, see FIGS. 4A–4C). Accordingly, inner side surfaces of the segments 14, 20 are complementarily shaped relative to displacement devices of the anchoring device which function to radially outwardly displace the segments into contact with the wellbore. Specifically, the upper segments 14 have multiple inclined surfaces 22 formed internally thereon, and the lower segments have a single inclined surface 24. The inclined surfaces 22, 24 are oppositely oriented with respect to each other, since the anchoring device representatively described hereinbelow has oppositely directed displacement devices. However, it is to be clearly understood that it is not necessary for the inner side surfaces of the segments 14, 20 to have the inclined surfaces 22, 24 formed thereon, for the surfaces to be oppositely oriented, or for there to be greater or lesser numbers of either of the surfaces. For example, instead of a inclined surfaces 22, 24 being used to radially displace the segments 14, 20, the anchoring device may instead directly radially displace the segments, insert an enlarged diameter mandrel therein to displace the segments, etc.

The upper segments 14 are circumferentially spaced apart by axially extending spaces 26, and the lower segments 20 are circumferentially spaced apart by axially extending spaces 28. The upper spaces 26 terminate at the upper axial end of the body 16, and the lower spaces 28 terminate at the lower axial end of the body. One of the spaces 26 is aligned with the slot 18, and one of the spaces 28 is also aligned with the slot 18, so that a continuous axial passageway 30 is provided through a sidewall portion of the slip 10. In a manner that will be more fully described hereinbelow, this passageway 30 permits installation of lines through the slip 10 without requiring any splicing of the lines.

The spaces 26, 28 also contribute to a unique feature of the present invention which permits the segments 14, 20 to flex relative to the body 16 as they are engaging the wellbore. This flexing of the segments 14, 20 permits an even distribution of the forces causing the segments to engage the wellbore, and permits the segments to conform to the shape of the wellbore. Thus, the segments 14, 20 and body 16 are stressed less, required setting forces are reduced, the ability of the segments to resist loads is increased and localized stresses in the wellbore are reduced.

Such flexibility is achieved by extending the upper spaces 26 axially inward from the upper segments 14 to form a series of circumferentially spaced apart transition members 32. Similarly, the lower spaces 28 extend axially inward from the lower segments 20 to form a series of circumferentially spaced apart transition members 34. Since the segments 14, 20, body 16 and transition members 32, 34 are integrally formed in the representatively illustrated slip 10, dashed lines have been provided in FIG. 3 to indicate approximate demarcations between the body 16 and the transition members 32, 34, and between the transition members and the segments 14, 20. It is to be understood, however, that it is not necessary for the slip 10 to be integrally formed of a single piece of material, and that separate flexible members may interconnect the segments 14, 20 to the body 16, without departing from the principles of the present invention.

Each of the upper and lower transition members 32, 34 has a flexibility which is greater than that of the body 16. In this manner, each of the transition members 32, 34 permits its corresponding one of the segments 14, 20 to displace substantially independently of the body 16. It is to be clearly understood, however, that it is not necessary for an engagement member constructed in accordance with the principles of the present invention to include transition members 32, 34, or for the transition members to have these defined flexibilities. For example, the transition members 32 may be more flexible than the segments 14, but less flexible than the body 16, although that is not a preferred configuration.

The transition members 32, 34 permit the segments 14, 20 to twist and/or flex to fully conform to the shape of the wellbore, without also requiring the body 16 to conform as well. Thus, greater and more uniform contact is achieved between the segments 14, 20 and the wellbore, resulting in even load distribution and greater load capacity. As noted above, a typical C-shape cross-sectioned member will take on an elliptical, oval, etc. shape when radially deflected. The transition members 32, 34 enable the body 16 to have a shape other than that of the wellbore, without causing the segments 14, 20 to also take on that shape. In this manner, the transition members 32, 34 dissipate stresses in the body 16 and thereby prevent those stresses from being imparted to the segments 14, 20.

As used herein, the term "flexible" is used to refer to an ability to deflect a member. Thus, as will be readily appreciated by a person of ordinary skill in the art, the upper segments 14 are more readily deflected radially due to the presence of the transition members 32 attaching the segments to the body 16. The transition members 32 may also permit increased deflection of the segments 14 laterally. The lengths of the transition members 32 allows the extended segments 14, 20 to conform to the casing inner diameter, while the portion of each transition member adjacent the body 16 conforms to the shape of the body.

Referring additionally now to FIGS. 4A–4C, an anchoring device 40 embodying principles of the present invention is representatively illustrated. The anchoring device 40 is representatively illustrated as a tubing hanger, but it is to be clearly understood that other types of anchoring devices may be constructed in accordance with the principles of the present invention. For example, a packer, plug, liner hanger, lock mandrel for a safety valve, etc., may also be constructed in accordance with the principles of the present invention.

The tubing hanger 40 includes an inner generally tubular mandrel 42, an upper displacement device or wedge 44, a lower displacement device or wedge 46, a piston 48 and a piston housing 50. As depicted and described herein, the tubing hanger 40 is of the type which is settable by application of fluid pressure thereto via a setting control line 52 connected thereto and extending to the earth's surface. However, it is to be understood that the tubing hanger 40 may be otherwise settable, for example, by application of axial force thereto, etc., without departing from the principles of the present invention.

The slip 10 is installed on the tubing hanger 40 with the wedges 44, 46 being positioned for cooperative engagement with the inclined surfaces 22, 24, respectively. The upper wedge 44 has multiple mating inclined surfaces 54, and the lower wedge 46 has a single mating inclined surface 56 formed externally thereon. Note that the inclined surfaces 54 may be progressively axially spaced as more fully described in a copending patent application Ser. No. 08/611,867, filed Mar. 6, 1996 and now U.S. Pat. No. 5,701,954, assigned to the assignee of the present invention.

The upper wedge 44 is threadedly attached to the mandrel 42, and the piston housing 50 is sealingly attached to the mandrel. In order to set the tubing hanger 40, fluid pressure is applied to the setting control line 52 at the earth's surface, the piston 48 is thereby displaced axially upward, causing axially upward displacement of the lower wedge 46. The upper and lower wedges 44, 46 are, thus, brought closer to each other and the slip 10 is forced radially outward by the inclined surfaces 54, 56. Subsequent downward displacement of the lower wedge 46 is prevented by an internal slip mechanism 74, which permits upward displacement of the lower wedge 46, but grips the outer surface of the mandrel 42 as the lower wedge begins to displace downward.

The piston 48 is axially slidingly and sealingly disposed radially between the mandrel 42 and the piston housing 50. The setting control line 52 is in fluid communication with an interior chamber 58 formed between the piston 48, piston housing 50 and mandrel 42, as indicated by the dashed lines in FIG. 4C

Note that the setting control line 52 extends axially beneath the slip 10, that is, radially inward from the segments 14, 20, transition members 32, 34 and body 16. Thus, there is a need to provide a terminal in the setting control line 52 for connection of the control line while the tubing hanger 40 is being installed in the well. For this purpose, a connector 60 is provided and disposed within a trough or recess 62 formed externally on the upper wedge 44. Another recess 64 is formed on the lower wedge 46, and still another recess 53 is formed on the piston housing 50 to receive the setting control line 52 therein.

Additional lines 66 are installed on the tubing hanger 40. These lines may be electrical data transmission or power lines, fiber optic lines, hydraulic control or monitoring lines, or any other type of line for which there may be a desire to install the line on the tubing hanger 40. In an important aspect of the present invention, one or more of the lines 66 may be installed on the tubing hanger 40 through the slip 10, without requiring splicing of the lines.

As will be readily appreciated by one of ordinary skill in the art, the lines 66 may be inserted into the passageway 30 of the slip 10 as the tubing hanger 40 is being lowered into the wellbore. FIGS. 4A–4C representatively show the lines 66 installed in the passageway 30, extending axially upward through a slot 68 formed externally on the upper wedge 44, and extending axially downward through a slot 70 formed externally on the lower wedge 46 and a slot 72 formed externally on the piston housing 50. The lines 66 may be secured to the tubing hanger 40 using conventional methods, such as by banding them to the tubing hanger and to the remainder of a tubing string interconnected above and below the tubing hanger.

To maintain alignment of the passageway 30 with the slots 68, 70, the lower wedge 46 is prevented from rotating relative to the upper wedge 44 by a plunger 76 threadedly attached to the upper wedge and axially slidingly received in an axially extending hole 78 formed in the lower wedge. The slip 10 is prevented from rotating relative to the lower wedge 46 by a roll pin 80 installed through one of the spaces 28 and into the lower wedge. Additionally, the lower wedge 46 is releasably secured against axial displacement relative to the mandrel 42 by a shear pin 82. The piston housing 50 may be rotated for alignment of the slot 72 with the slots 68, 70 and passageway 30 during assembly of the tubing hanger 40.

Figure 5:
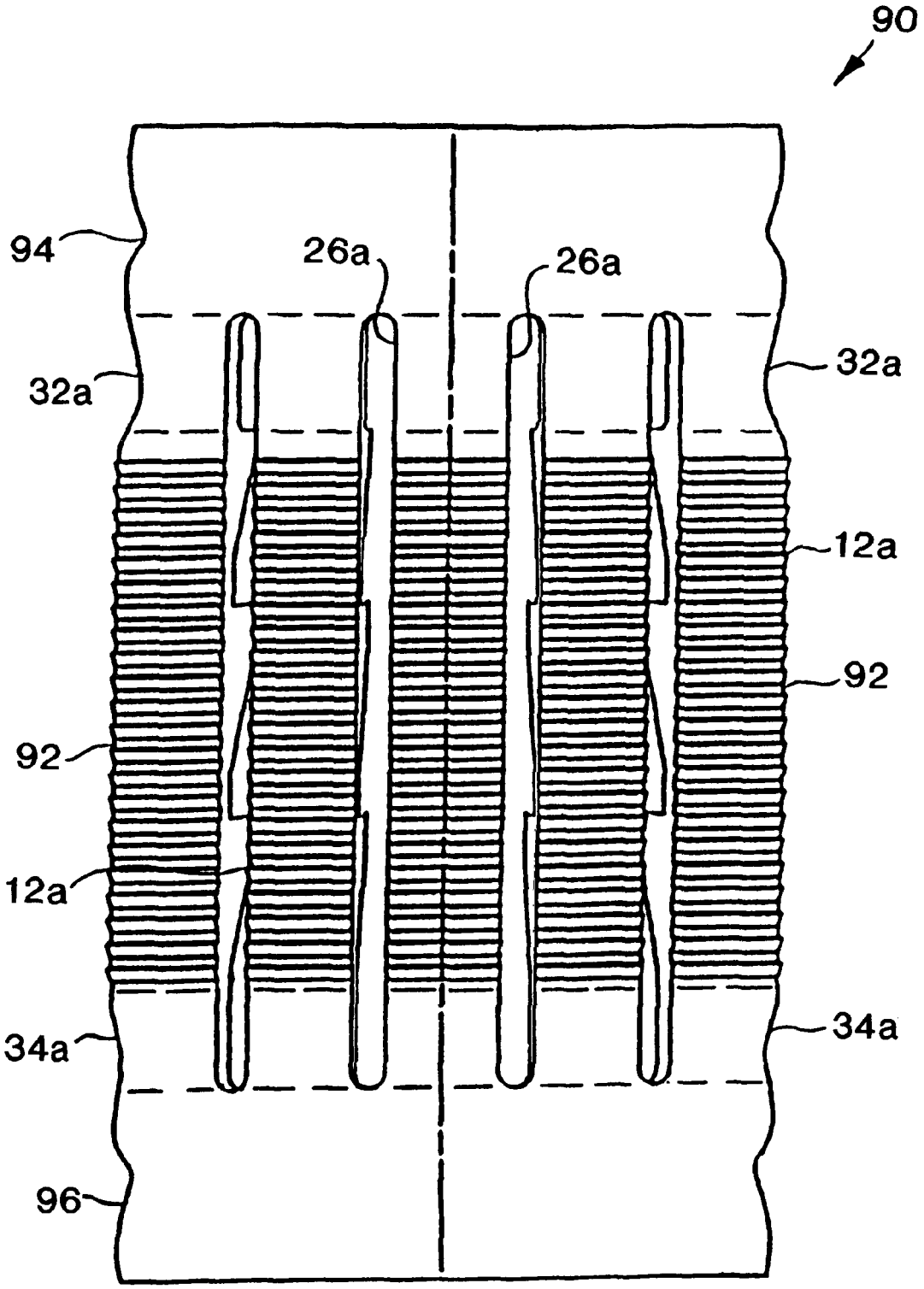
FIG. 5 is a partial elevational view of another slip embodying principles of the present invention.

Referring additionally now to FIG. 5, another slip 90 embodying principles of the present invention is representatively illustrated. The slip 90 is generally tubular in shape. For illustrative clarity, only a partial elevational view of the slip 90 is depicted in FIG. 5, it being understood that the slip extends circumferentially about its longitudinal axis in a manner similar to the slip 10 shown in FIGS. 1–3. Elements of the slip 90 which are similar to previously described elements of the slip 10 are indicated in FIG. 5 using the same reference numbers, with an added suffix "a".

In substantial part, the slip 90 differs from the slip 10 in that the slip 90 includes a series of axially extending segments 92 (which are configured somewhat similar to the upper segments 14 of the slip 10) attached between an upper body 94 and a lower body 96. Each of the bodies 94, 96 is generally C-shaped, with an axially extending slot (not shown in FIG. 5, see slot 18 of FIG. 1) formed through a sidewall portion thereof. The slots in the bodies 94, 96 are aligned with one of a series of spaces 26*a* circumferentially separating the segments 92, thereby forming a passageway (not shown in FIG. 5, see passageway 30 of FIG. 1) for lines therethrough.

A series of transition members 32*a* forms a flexible attachment of each of the segments 92 to the upper body 94. Another series of transition members 34*a* forms a flexible attachment of each of the segments 92 to the lower body 96. Thus, each of the segments 92 is flexibly attached between the bodies 94, 96 by a corresponding one of the transition members 32*a* and a corresponding one of the transition members 34*a*.

The segments 92, bodies 94, 96 and transition members 32*a*, 34*a* are integrally formed in the representatively illustrated slip 90, so dashed lines have been provided in FIG. 5 to indicate approximate demarcations between the bodies and the transition members, and between the transition members and the segments. It is to be understood, however, that it is not necessary for the slip 90 to be integrally formed of a single piece of material, and that separate flexible members may interconnect the segments 92 to the bodies 94, 96, without departing from the principles of the present invention.

Each of the upper and lower transition members 32*a*, 34*a* has a flexibility which is greater than that of the respective one of the bodies 94, 96 to which it is attached. In this manner, each respective pair of the transition members 32*a*, 34*a* permits its corresponding one of the segments 92 to displace substantially independently of the bodies 94, 96. It is to be clearly understood, however, that it is not necessary for an engagement member constructed in accordance with the principles of the present invention to include transition members 32*a*, 34*a*, or for the transition members to have these defined flexibilities. For example, the transition members 32*a* or 34*a* may be more flexible than the segments 92, but less flexible than one or both of the bodies 94, 96, although that is not a preferred configuration.

The transition members 32*a*, 34*a* permit the segments 92 to twist and/or flex to fully conform to the shape of the wellbore, without also requiring the bodies 94, 96 to conform as well. Thus, greater and more uniform contact is achieved between the segments 92 and the wellbore, resulting in even load distribution and greater load capacity. As noted above, a typical C-shape cross-sectioned member will take on an elliptical, oval, etc. shape when radially deflected. The transition members 32*a*, 34*a* enable each of the bodies 94, 96 to have a shape other than that of the wellbore, without causing the segments 92 to also take on that shape. In this manner, the transition members 32*a*, 34*a* dissipate stresses in the bodies 94, 96 and thereby prevent those stresses from being imparted to the segments 92. Thus, as will be readily appreciated by a person of ordinary skill in the art, the segments 92 are more readily deflected radially due to the presence of the transition members 32*a*, 34*a* attaching the segments to the bodies 94, 96. The transition members 32*a*, 34*a* may also permit increased deflection of the segments 92 laterally. The lengths of the transition members 32*a*, 34*a* allow the extended segments 92 to conform to the casing inner diameter, while the portions of each transition member adjacent one of the bodies 94, 96 conforms to the shape of the respective body.

Of course, a person of ordinary skill in the art may make changes, such as modifications, additions, substitutions, deletions, etc., to the slips 10, 90 and tubing hanger 40 described herein, which changes would be obvious. These changes are contemplated by the principles of the present invention. The slips 10, 90 and tubing hanger 40 are only representative embodiments of engagement devices and anchoring devices which may be constructed in accordance with the principles of the present invention. Accordingly, the foregoing detailed description is to be clearly understood as being given by way of illustration and example only, the spirit and scope of the present invention being limited solely by the appended claims.

What is claimed is:

1. An engagement member operatively positionable within a subterranean well, the engagement member comprising:

a generally tubular first body;

a plurality of first segments attached to the first body;

a plurality of first spaces, each of the plurality of first spaces being positioned between a corresponding pair of the plurality of first segments; and a first slot formed through a sidewall portion of the first body, the first slot being aligned with one of the plurality of first spaces.

2. The engagement member according to claim 1, wherein the first slot and the one of the plurality of first spaces cooperatively form a continuous passageway through the engagement member.

3. The engagement member according to claim 1, further comprising a plurality of first transition members, each of the plurality of first transition members forming an attachment between one of the plurality of first segments and the first body.

4. The engagement member according to claim 3, wherein the plurality of first segments, plurality of first transition members and first body are integrally formed.

5. The engagement member according to claim 3, wherein the plurality of first transition members are configured to permit displacement of the plurality of first segments relative to the first body.

6. The engagement member according to claim 3, wherein the plurality of first transition members form flexible attachments of the plurality of first segments to the first body.

7. The engagement member according to claim 1, wherein the plurality of first segments and plurality of first spaces extend generally axially outward from an axial end of the first body.

8. The engagement member according to claim 1, further comprising:

a plurality of second segments attached to the first body; and a plurality of second spaces, each of the second spaces being positioned between a corresponding pair of the plurality of second segments, one of the plurality of second spaces being aligned with the first slot.

9. The engagement member according to claim 8, further comprising a plurality of second transition members, each of the plurality of second transition members forming an attachment between one of the plurality of second segments and the first body.

10. The engagement member according to claim 1, further comprising a generally tubular second body, each of the plurality of first segments being attached to the second body.

11. The engagement member according to claim 10, further comprising a second slot formed through a sidewall portion of the second body, the second slot being aligned with the one of the plurality of first spaces.

12. The engagement member according to claim 10, further comprising a plurality of second transition members, each of the plurality of second transition members forming an attachment between one of the plurality of first segments and the second body.

13. The engagement member according to claim 12, wherein the plurality of second transition members form flexible attachments of the plurality of first segments to the second body.

14. A slip for use with an anchoring device operatively positionable within a subterranean well, the slip comprising:

a first series of circumferentially spaced apart segments; and a body having a generally C-shaped cross-section, each of the first segments being attached to the body.

15. The slip according to claim 14, wherein each of the first segments is attached to one axial end of the body.

16. The slip according to claim 14, further comprising a second series of circumferentially spaced apart segments, each of the first series of segments being attached to one axial end of the body, and each of the second series of segments being attached to the other axial end of the body.

17. The slip according to claim 14, wherein each of the first segments is flexibly attached to the body.

18. The slip according to claim 14, further comprising a series of transition members, each of the transition members attaching a corresponding one of the first segments to the body.

19. The slip according to claim 18, wherein each of the transition members permits its corresponding one of the first segments to displace substantially independently of the body.

20. The slip according to claim 18, wherein each of the transition members has a flexibility greater than the body.

21. The slip according to claim 14, wherein the body has a first slot formed therethrough, wherein a pair of the first segments are circumferentially separated by a second slot, and wherein the first and second slots are aligned.

22. The slip according to claim 21, further comprising a second series of circumferentially spaced apart segments, each of the second segments being attached to the body, a pair of the second segments being circumferentially separated by a third slot, and wherein the third slot is aligned with the first and second slots.

23. The slip according to claim 14, further comprising a generally axially extending line positioned between an adjacent pair of the first segments.

24. The slip according to claim 23, wherein the line is further positioned within a slot formed through a sidewall portion of the body.

25. An anchoring device operatively positionable within a wellbore of a subterranean well, the anchoring device comprising:

an engagement member having a slot formed through a sidewall portion thereof; and a line extending through the slot in the engagement member.

26. The anchoring device according to claim 25, wherein the slot through the engagement member is formed between two of a series of segments and through a generally tubular body, the segments being attached to the body.

27. The anchoring device according to claim 25, wherein the slot is aligned with, and forms a portion of, a passageway extending generally axially outward from each end of the engagement member.

28. The anchoring device according to claim 27, wherein the passageway extends into a displacement member, the displacement member being secured against rotational displacement relative to the engagement member.

29. The anchoring device according to claim 25, further comprising a generally tubular mandrel, and wherein the engagement member substantially completely radially outwardly encircles the mandrel.

30. The anchoring device according to claim 25, wherein the engagement member has a toothed outer side surface formed thereon.

31. The anchoring device according to claim 25, wherein an outer side surface of the engagement member is configured for engagement with an item of equipment positioned within the wellbore.

32. An anchoring device operatively positionable within a wellbore of a subterranean well, the anchoring device comprising:

a mandrel;

a first wedge axially slidably disposed on the mandrel; and a slip positioned relative to the first wedge, the slip having a first series of circumferentially spaced apart segments, each of the first segments having an inner side surface complementarily shaped relative to the first wedge, and a body having a generally C-shaped cross-section, each of the first segments being attached to the body.

33. The anchoring device according to claim 32, further comprising an axially extending external line, the line being positioned between an adjacent pair of the first segments.

34. The anchoring device according to claim 32, wherein the slip further has a second series of circumferentially spaced apart segments attached to the body.

35. The anchoring device according to claim 34, wherein the second segments are oppositely oriented relative to the first segments.

36. The anchoring device according to claim 34, further comprising a second wedge, and wherein each of the second segments has an inner side surface formed thereon complementarily shaped relative to the second wedge.

37. The anchoring device according to claim 32, further comprising first and second generally axially extending lines, the first line being positioned at least partially radially within the slip, and the second line being positioned at least partially circumferentially between two of the segments.

38. The anchoring device according to claim 32, wherein the first wedge has a generally axially extending trough formed externally thereon, and wherein the slip is releasably secured to the first wedge, the trough being radially aligned with a generally axially extending slot formed through the body.

39. The anchoring device according to claim 38, further comprising a second wedge axially slidingly disposed relative to the mandrel, the first and second wedges being secured against rotation relative to each other.

* * * * *